United States Patent [19]

Mason

[11] 4,019,709

[45] Apr. 26, 1977

[54] DRUM STAND

[76] Inventor: Harold F. Mason, P.O. Box 10139, Tampa, Fla. 33679

[22] Filed: May 30, 1975

[21] Appl. No.: 582,437

[52] U.S. Cl. ..... 248/150; 248/165; 248/434; 248/439

[51] Int. Cl.[2] ..... A47G 23/02

[58] Field of Search ..... 248/150, 145.6, 165, 248/166, 434, 435, 439; 229/1.5 B, DIG. 6; 220/85 H; 240/52.5

[56] References Cited

UNITED STATES PATENTS

| | | | |
|---|---|---|---|
| 1,223,065 | 4/1917 | Meyer | 248/439 |
| 2,060,781 | 11/1936 | Annen | 229/1.5 B |
| D129,823 | 10/1941 | Reiber | 229/1.5 B |

FOREIGN PATENTS OR APPLICATIONS

| | | | |
|---|---|---|---|
| 695,333 | 9/1930 | France | 248/150 |
| M19,157 | 6/1956 | Germany | 248/150 |
| 298,562 | 7/1932 | Italy | 248/150 |

*Primary Examiner*—Robert A. Hafer

[57] ABSTRACT

A stand device used in combination with a container such as a drum having a substantially cylindrical configuration wherein at least two support legs are movable into and out of supporting relation. Each of the supporting legs comprises a configuration substantially corresponding to the exterior surface of the container such that in its non-supporting position, the legs are disposed in substantially flush engagement with the exterior surface due to an indentation formed in the exterior surface corresponding to the dimension and thickness of the leg means.

3 Claims, 5 Drawing Figures

DRUM STAND

BACKGROUND OF THE INVENTION

1. Field of the Invention

This invention is directed to a supporting device in the form of a stand or like structure movably connected to a container so as to be positioned in both supportive and non-supportive position relative to the container and configured when in its non-supportive position to substantially conform to the configuration of the container in order to facilitate storage and/or transportation.

DESCRIPTION OF THE PRIOR ART

There are present in the prior art and also commercially available a number of various types of support devices in the form of stands, braces, platforms, etc., designed to maintain containers of various types and configuration in a given supportive attitude or position.

Normally however, such stands are an auxiliary structure which is not accompanying a given container. This is especially true with the larger size containers holding both liquids and solids. The use of large drum-like containers frequently requires some type of support device when the contents of these containers are utilized or used up on a gradual basis. In utilizing these containers, when support devices are required, it has been found to be an obvious inconvenience to procure various types of auxiliary or makeshift stands. Such commercially available prior art devices are generally represented in the U.S. patents to Young, U.S. Pat. Nos. 1,375,403, Marcus, 2,177,073, Mayor, 2,466,323, Emory 2,746,703, Shelby 2,846,708, Bremer 3,013,757, Jay, 3,476,260, Schnider 3,747,780.

In addition, the U.S. Pat. No. 1,476,542 to Rasmussen showed a supporting device for a casing wherein the supporting device itself is movably attachable to the casing so as to move into and out of a supporting position relative to the casing. This structure and the concept of combining a casing with a "built-in" support stand has obvious advantages and in certain applications is much more efficient than the requirement of providing a supplementary suport stand or like device.

Accordingly, there is a need for a container having an attached supporting device or stand capable of maintaining the container in a predetermined orientation. Such a supporting device should be structured and configured for disposal in a non-interferring position relative to the intended use of the container during its storage, transportation and various uses.

SUMMARY OF THE INVENTION

This invention is directed to a support device of the type used in combination with and attached to a container. For purposes of illustration and explanation the subject invention is described with reference to a cylindrically configured drum-like container. However, it is intended that the subject structure, which is the subject of the present invention, can be utilized with containers of various sizes and configurations while still including the basic inventive structure set forth hereinafter.

The support device comprises supporting leg means in the form of at least two or alternately a plurality of support legs movably attached to the outer surface of the container being supported. The support legs are interconnected to one another and to the exterior surface of the container by a base means serving to interconnect correspondingly disposed portions of the plurality of support legs. The base means itself may take a variety of configurations corresponding to the particular configuration of the leg portion which it engages. The base means itself is fixedly attached to the exterior of the container and serves as a pivot point or axis of rotation. Being movably connected in this manner, each of the leg means are movable into and out of a container supporting position relative to the ground or surface on which the container is intended to be positioned. As will be described in greater detail hereinafter, the non-supportive position is defined by each of the leg elements disposed in substantially flush relation to correspondingly position portions of the exterior surface of the container. Accordingly, each of the leg elements have a configuration which essentially corresponds to the outer surface of the container.

In at least one of the embodiments of the present invention, each of the leg means comprises a substantially arcuate configuraton which corresponds with the cylindrical configuration of the outer surface of the drum like container.

The container means further comprises indentation means having a shape or configuration generally similar or compatible with the overall configuration of the support legs comprising the support means. Accordingly, when the support legs are rotated into their non-supportive relation they are maintained within the indentation so as to define a substantially flush outer surface of the container. In this manner, the container, with the support legs in their non-supportive position, may be stored, transported, or otherwise maintained in a normal fashion in that the support legs are positioned to substantially correspond with the overall configuration and not protrude therefrom in an interruptive fashion.

A retention means may be further interconnected between each of the support legs when they are positioned in their supportive relation relative to the container. In this manner, the support legs are "locked" in their supportive position and the container is securely supported thereon. This prevents the inadvertent or accidental movement of the support legs into their non-supportive position.

This invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 2:
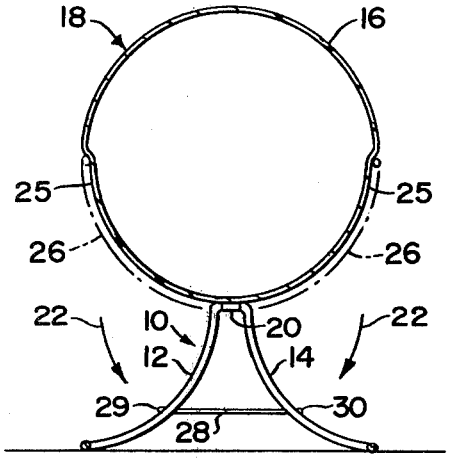
FIG. 2 is a sectional view taken along line 2—2 of FIG. 1.
Figure 5:
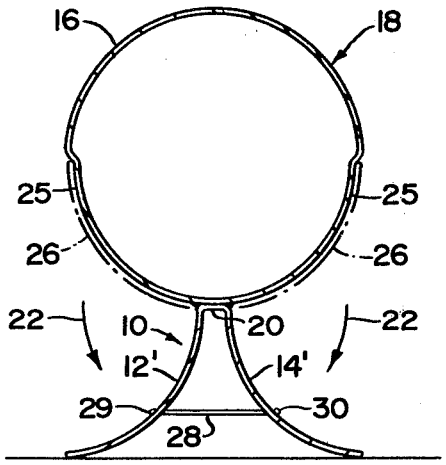
FIG. 5 is a sectional view along line 5—5 of FIG. 4.

As shown, the support device of the present invention is generally indicated as 10. The device comprises leg support means including at least two leg elements 12 and 14. Each leg element is movably attached to the exterior surface 16 of container 18. More specifically, a base means 20 may take a plurality of configurations but is fixedly attached to the exterior surface 16 of container 18 and also is disposed to interconnect corresponding extremities or portions of the leg means 12 and 14. This disposition serves to allow pivotal or rotational movement relative to the surface as indicated by directional arrows 22. As best shown in FIGS. 2 and 5, each of the leg elements 12 and 14 are correspondingly configured to the exterior surface 16 of the container 18. In the particular embodiment shown, the configuration of leg means 12 and 14 is substantially arcuate so as to correspond to the cylindrical surface 16 as shown.

An identation means is formed in the exterior surface. This indentation means 25 has a depth substantially corresponding to the thickness or width of each of the prospective leg means 12 and 14 mounted therein. The non-supporting position as represented in broken lines and indicated as 26 is defined by the leg elements 12 and 14 formed within the indentation means 25.

Retention means 28 may be disposed in interconnecting relation between the various leg portions 12 and 14. By virtue of this arrangement, the leg elements 12 and 14 are "locked" in the position shown in FIGS. 2 and 5. This serves to maintain the leg elements in the container supportive position as represented and thereby prevent or reduce the possibility of inadvertent collapse of the leg elements upwardly into its non-supportive position. The retention means 28, as shown, has its opposite extremities 29 and 30 attached to the opposite legs at any given applicable location.

Figure 1:
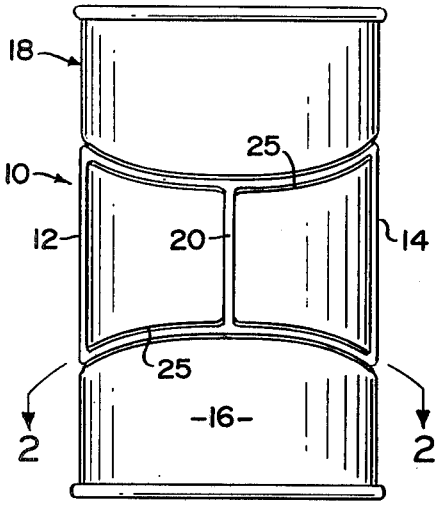
FIG. 1 is a bottom plan view showing the support leg means of the present invention in supporting position.
Figure 4:
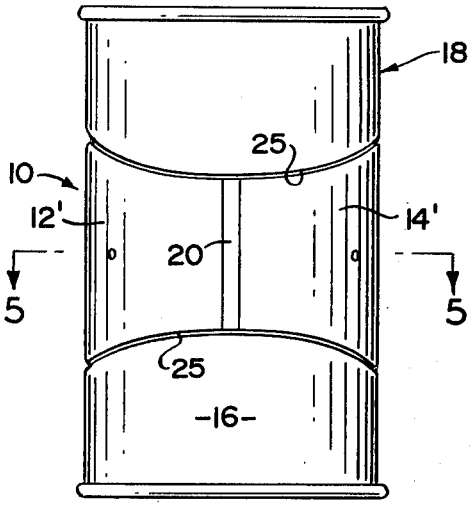
FIG. 4 is a bottom plan view of yet another embodiment of the present invention.
Figure 3:
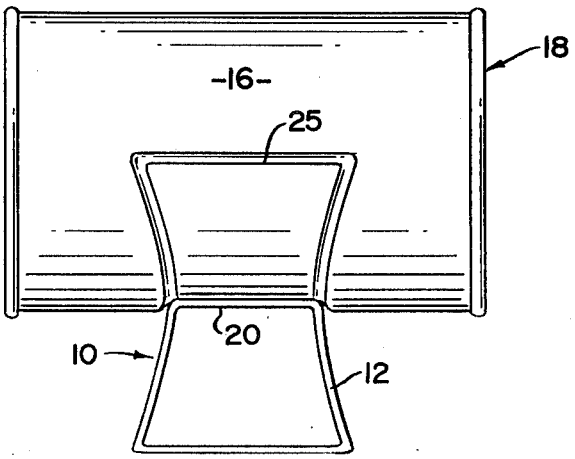
FIG. 3 is a side view of the embodiment shown in FIGS. 1 and 2.

One embodiment of the present invention as best shown in FIGS. 1 and 3 has the individual leg elements formed of a substantially elongated stock wherein the configuration defines a curvilinear path along the length of the individual legs 13 and 14.

In another embodiment of the present invention the individual leg elements 12 and 14 comprise a sheet like material having a substantially curvilinear configuration corresponding to the outer surface of the container 18 as set forth above. In this embodiment, the indentation means 25 has a substantially planar configuration corresponding to the curvilinear but planar or cylindrical configuration of each of the leg elements 12' and 14' shown in the embodiments represented in FIGS. 1 and 5. Alternately, the embodiments of FIGS. 1, 2 and 3 has the indentation means 25 in a substantially groove or track-like configuration corresponding to the configuration of the elongated stock forming each of the leg elements 12 and 14.

It will thus be seen that the objects made apparent from the preceding description are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features herein described, and all statements of the scope of the invention which, as a matter of language, might be said to fall therebetween.

Now that the invention has been described,

What is claimed is:

1. A support device in combination with a substantially cylindrical container having an external surface including indentation means formed in inset relation to the exterior surface of the container, said indentation means extending about a substantial portion of the substantially cylindrical container, said support device comprising:

first and second support leg means each having a arcuate configuration substantially corresponding to the curved surface of the substantially cylindrical container;

base means affixedly attached to the substantially cylindrical container and disposed in interconnecting relation between said first and second support leg means and the container said first and second leg means being movably interconnected to said base and being movable relative to the substantially cylindrical container and between a supporting and a non-supporting position; and retaining means disposed in interconnecting relation to each of said leg means when in said supporting position, whereby said leg means are maintained in said supporting position due to interconnection by said retaining means;

said indentation means being a depth dimension substantially equal to the thickness of each of said first and second support leg means to establish a substantially flush engagement between said first and second support leg means and the exterior surface of the substantially cylindrical container enabling the container to be rolled when said first and second support leg means are positioned in said indentation means in the non-support position.

2. A support device as in claim 1 wherein each of said leg means is formed from substantially elongated stock having a curvature along its length conforming to the curved perimeter of a cylindrical container to which it is to be attached.

3. A support device as in claim 1 wherein each of said leg means is formed from substantially sheet stock having a curvature conforming to the outer curved surface of a cylindrical container to which it is to be attached.

* * * * *